US009328629B2

(12) United States Patent
Scott et al.

(10) Patent No.: US 9,328,629 B2
(45) Date of Patent: May 3, 2016

(54) OUTER CASE WITH GUSSETED BOSS

(71) Applicant: United Technologies Corporation, Hartford, CT (US)

(72) Inventors: Jonathan Ariel Scott, Tolland, CT (US); Jorge I. Farah, Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 888 days.

(21) Appl. No.: 13/631,770

(22) Filed: Sep. 28, 2012

(65) Prior Publication Data

US 2014/0093368 A1 Apr. 3, 2014

(51) Int. Cl.
*F01D 25/24* (2006.01)
*F01D 25/28* (2006.01)
*F01D 25/16* (2006.01)

(52) U.S. Cl.
CPC ..... *F01D 25/162* (2013.01); *F01D 25/24* (2013.01)

(58) Field of Classification Search
CPC ..... F01D 25/24; F01D 25/243; F01D 25/246; F01D 25/284; F01D 25/285; F05D 2240/14
USPC ..... 415/126, 201, 213.1
See application file for complete search history.

(56) References Cited

U.S. PATENT DOCUMENTS 2,217,081 A * 10/1940 Stough ..... B60B 3/16 301/35.626
2,282,721 A * 5/1942 Hall ..... F02B 75/26 123/193.1
2,596,465 A * 5/1952 Booth ..... A47B 13/08 38/137
2,875,579 A * 3/1959 Gerdan ..... F02C 7/20 60/726
4,050,241 A * 9/1977 DuBell ..... F23M 5/085 60/757
4,652,244 A * 3/1987 Drury ..... B63H 11/102 114/183 R
5,483,792 A * 1/1996 Czachor ..... F01D 25/162 60/796
7,748,209 B1 * 7/2010 Schopf ..... F01D 5/082 60/39.08
2003/0131603 A1 * 7/2003 Bolender ..... F23R 3/002 60/772
2003/0189028 A1 * 10/2003 Wright ..... B23K 9/048 219/76.12
2004/0069561 A1 * 4/2004 Cox ..... H04R 1/02 181/199
2008/0276621 A1 * 11/2008 Somanath ..... F01D 25/162 60/796
2010/0021286 A1 * 1/2010 Somanath ..... F01D 25/162 415/126
2010/0125770 A1 5/2010 Keith, Jr.
2012/0163964 A1 * 6/2012 Chuong ..... F01D 25/246 415/191
2012/0177490 A1 * 7/2012 Lussier ..... F01D 25/28 415/213.1
2013/0224010 A1 * 8/2013 Farah ..... F01D 25/162 415/209.2
2013/0224012 A1 * 8/2013 Durocher ..... F01D 25/28 415/213.1

* cited by examiner

*Primary Examiner* — Dwayne J White
*Assistant Examiner* — Joshua R Beebe
(74) *Attorney, Agent, or Firm* — Kinney & Lange, P.A.

(57) ABSTRACT

An outer case employed in a gas turbine engine includes a plurality of support member bosses and a plurality of gusseted bosses. The plurality of support member bosses are disposed circumferentially around the outer case for receiving and securing support members that attach the outer case to an inner hub. The plurality of gusseted bosses are disposed circumferentially around the outer case and between the plurality of support member bosses.

17 Claims, 2 Drawing Sheets

OUTER CASE WITH GUSSETED BOSS

BACKGROUND

The present invention is related to gas turbine engines, and in particular to the outer case of a gas turbine engine.

An outer engine case for a gas turbine engine includes multiple case sections that are secured to each other at flange connections The multiple case sections are required to facilitate installation of various internal gas turbine engine components such as a compressor assembly, combustor assembly, turbine assembly, and exhaust assembly. Typically, a number of outer case assemblies are employed, with the various outer case assemblies being bolted together at flanged joints. The outer case provides structural support for the various components of the gas turbine engine which are attached thereto. However, forces applied to the outer case can result in ovalization of the case, which is detrimental to the efficiency of the engine.

SUMMARY

An outer case employed in a gas turbine engine includes a plurality of support member bosses and a plurality of gusseted bosses. The plurality of support member bosses are disposed circumferentially around the outer case for receiving and securing support members that attach the outer case to an inner hub. The plurality of gusseted bosses are disposed circumferentially around the outer case and between the plurality of support member bosses.

DETAILED DESCRIPTION

Figure 1:
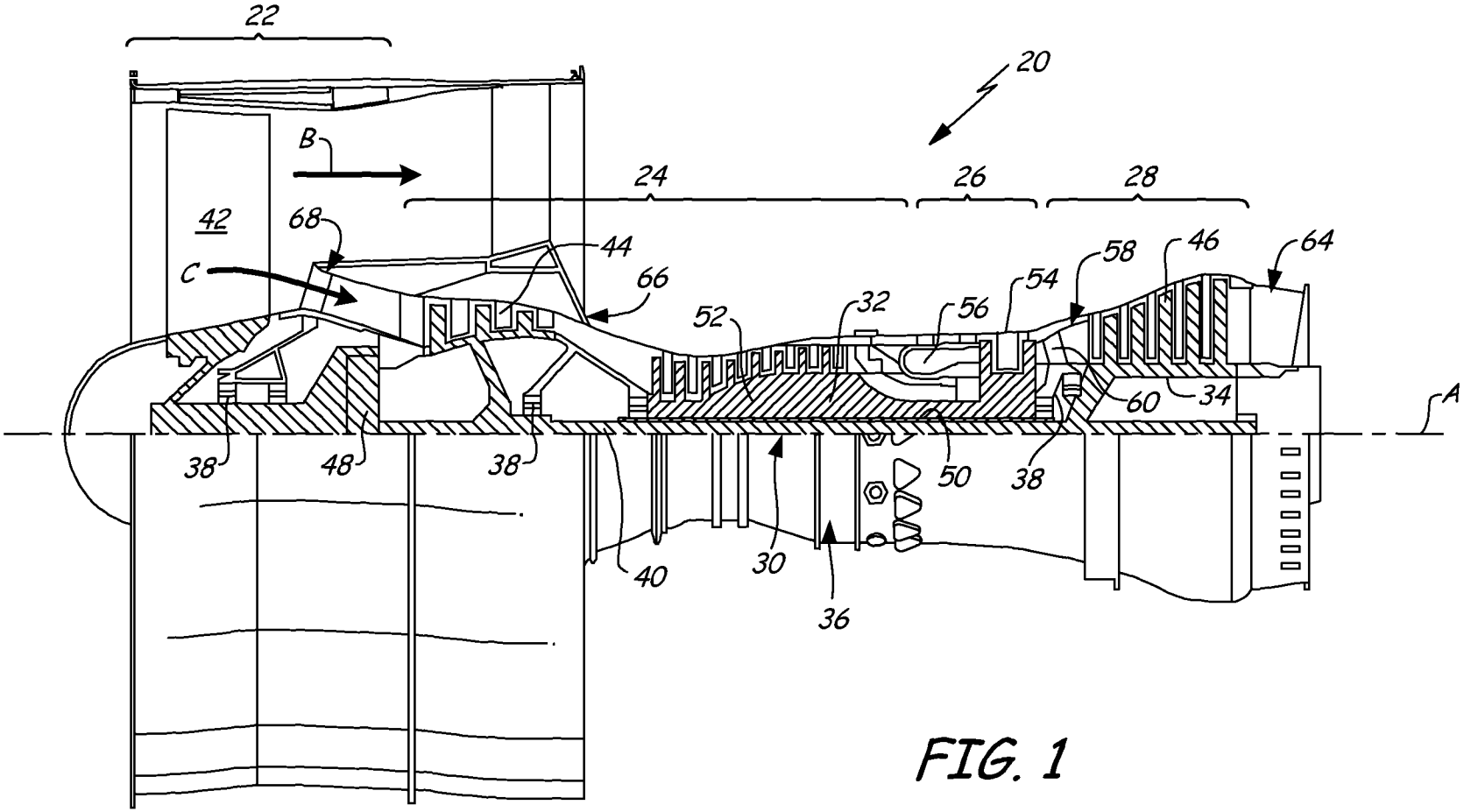
FIG. 1 schematically illustrates an example gas turbine engine that includes a fan section, a compressor section, a combustor section and a turbine section.

FIG. 1 schematically illustrates an example gas turbine engine 20 that includes fan section 22, compressor section 24, combustor section 26 and turbine section 28. Alternative engines might include an augmenter section (not shown) among other systems or features. Fan section 22 drives air along bypass flow path B while compressor section 24 draws air in along core flow path C where air is compressed and communicated to combustor section 26. In combustor section 26, air is mixed with fuel and ignited to generate a high pressure exhaust gas stream that expands through turbine section 28 where energy is extracted and utilized to drive fan section 22 and compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes low speed spool 30 and high speed spool 32 mounted for rotation about an engine central longitudinal axis A relative to outer case 36 via several bearing systems 38. It should be understood that various bearing systems 38 at various locations may alternatively or additionally be provided. As discussed in more detail with respect to FIG. 2, a plurality of gusseted bosses may be disposed circumferentially around outer case 36 at various axial locations in order to maintain system stiffness symmetry, thereby controlling ovalization and centerline shift.

Low speed spool 30 generally includes inner shaft 40 that connects fan 42 and low pressure (or first) compressor section 44 to low pressure (or first) turbine section 46. Inner shaft 40 drives fan 42 through a speed change device, such as geared architecture 48, to drive fan 42 at a lower speed than low speed spool 30. High-speed spool 32 includes outer shaft 50 that interconnects high pressure (or second) compressor section 52 and high pressure (or second) turbine section 54. Inner shaft 40 and outer shaft 50 are concentric and rotate via bearing systems 38 about engine central longitudinal axis A.

Combustor 56 is arranged between high pressure compressor 52 and high pressure turbine 54. In one example, high pressure turbine 54 includes at least two stages to provide a double stage high pressure turbine 54. In another example, high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of low pressure turbine 46 as related to the pressure measured at the outlet of low pressure turbine 46 prior to an exhaust nozzle.

Mid-turbine frame 58 of engine static structure 36 is arranged generally between high pressure turbine 54 and low pressure turbine 46. Mid-turbine frame 58 further supports bearing systems 38 in turbine section 28 as well as setting airflow entering low pressure turbine 46. As discussed in more detail with respect to FIG. 2, an outer case portion of mid-turbine frame 58 includes a plurality of gusseted bosses disposed circumferentially around the outer case to prevent ovalization due to forces communicated to the outer case from bearing assemblies 38.

The core airflow C is compressed by low pressure compressor 44 then by high pressure compressor 52 mixed with fuel and ignited in combustor 56 to produce high speed exhaust gases that are then expanded through high pressure turbine 54 and low pressure turbine 46. Mid-turbine frame 58 includes vanes 60, which are in the core airflow path and function as an inlet guide vane for low pressure turbine 46. Utilizing vane 60 of mid-turbine frame 58 as the inlet guide vane for low pressure turbine 46 decreases the length of low pressure turbine 46 without increasing the axial length of mid-turbine frame 58. Reducing or eliminating the number of vanes in low pressure turbine 46 shortens the axial length of turbine section 28. Thus, the compactness of gas turbine engine 20 is increased and a higher power density may be achieved.

The disclosed gas turbine engine 20 in one example is a high-bypass geared aircraft engine. In a further example, gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, gas turbine engine 20 includes a bypass ratio greater than about ten (10:1) and the fan diameter is significantly larger than an outer diameter of low pressure compressor 44. It should be understood, however, that the above parameters are only exemplary of one embodiment of a gas turbine engine including a geared architecture and that the present disclosure is applicable to other gas turbine engines.

Figure 2:
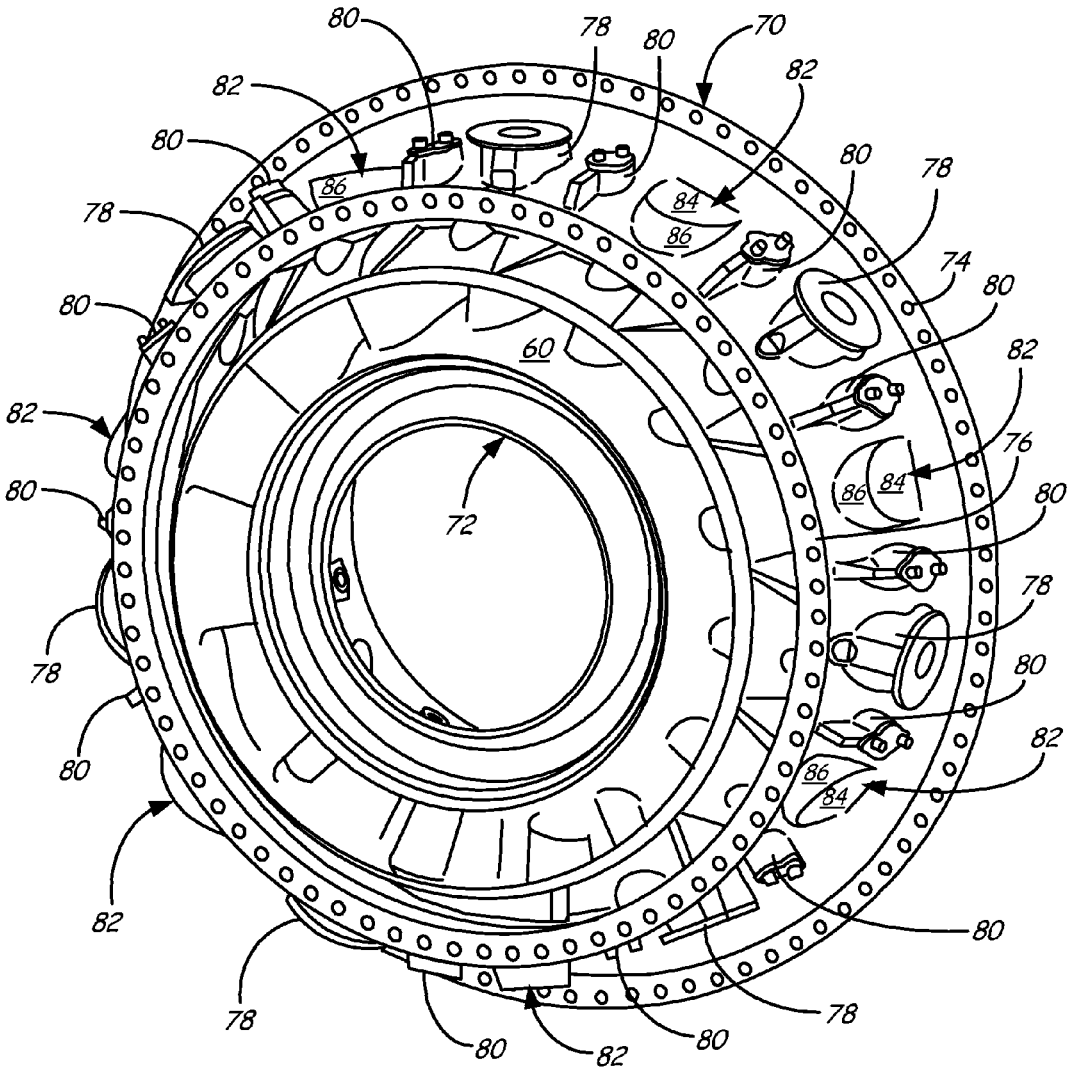
FIG. 2 is a perspective view of an outer case according to an embodiment of the present invention.

FIG. 2 is a perspective view of outer case 70 according to an embodiment of the present invention. In the embodiment shown in FIG. 2, outer case 70 is employed in a mid-turbine frame 58, discussed above with respect to FIG. 1, which in addition to outer case 70 includes vanes 60 (shown in FIG. 1) and inner hub 72 (not shown in FIG. 1). Although described with respect to mid-turbine frame 58, gusseted bosses may be employed with respect to any portion of the outer case in which ovalization control is desired.

Outer case 70 includes flanges 74 and 76 for connection to fore and aft case assemblies (not shown). Outer case further includes a plurality of support member bosses 78 disposed circumferentially around outer case 70 for receiving and securing support structures such as struts/rods that communicate forces from inner hub 72 to outer case 70. Additionally, a number of borescope plug/pin bosses 80 are similarly disposed circumferentially around outer case 70 that allow for insertion of a borescope for inspection of vanes 60. Although not shown in FIG. 2, additional bosses may be disposed circumferentially around the outer case to allow for the receiving and securing of oil service tubes that pass through inner but 72 and connect to the bearing housing.

In addition, a plurality of gusseted bosses 82 are disposed circumferentially around outer case 70, and between support member bosses 78 and/or borescope/plug bosses 80. In the embodiment shown in FIG. 2, each gusseted boss 82 is axially aligned with support member bosses 78 and borescope plug/pin bosses 80. None of the gusseted bosses 82 are associated with a support member or other connection to the outer case. Rather, each gusseted boss 82 is utilized for the sole purpose of maintaining system stiffness symmetry, thereby controlling ovalization and centerline shift.

The number and position of the gusseted bosses 82 act to balance stiffness provided by the main stiffness drivers such as outer case 70, inner hub 72, and the struts/rods connecting the outer case to the inner hub, with induced forces generated for example, by bearing loads, gearbox link loads, oil tank loads, and oil service tubes to provide equal system stiffness symmetry. For example, in the embodiment shown in FIG. 2, seven gusseted bosses are disposed on outer case 70, located between borescope plug/pin bosses 80.

Each gusseted boss 82 includes flat portion 84 is approximately parallel to the engine centerline axis A, and curved portion 86 that is substantially perpendicular to flat portion 84 and engine centerline axis A. In one embodiment, the interior of gusseted boss 82 includes a hollow portion (not shown) formed by flat portion 84 and curved portion 86, which reduces the weight of outer case 70 without affecting the load bearing capability of outer case 70. In particular, the geometry of gusseted bosses 82, and the placement of bosses 82 circumferentially around outer case 70, provides additional stiffness to outer case 70 that resists or prevents ovalization of outer case 70 in response to forces applied via support member bosses 78.

In an exemplary embodiment, an outer case employed in a gas turbine engine includes a plurality of support member bosses and a plurality of gusseted bosses. The plurality of support member bosses are disposed circumferentially around the outer case for receiving and securing support members that attach the outer case to an inner hub. The plurality of gusseted bosses are disposed circumferentially around the outer case and between the plurality of support member bosses.

In one embodiment, each of the plurality of gusseted bosses may include a flat portion extending from the outer case that is substantially parallel to an engine centerline axis and a curved portion extending between the outer case and the flat portion that is substantially perpendicular to the flat portion.

In another embodiment, each of the plurality of gusseted bosses may be axially aligned with the support member bosses.

In another embodiment, the outer case may be associated with a mid-turbine frame portion of the gas turbine engine.

In another embodiment, the plurality of gusseted bosses are located to maintain system stiffness symmetry.

In another embodiment, the plurality of gusseted bosses are located circumferentially around the outer case to provide ovalization control of the outer case.

In another embodiment, seven gusseted bosses are disposed circumferentially around the outer case.

In an exemplary embodiment, a mid-turbine employed in a gas turbine engine includes an inner hub, an outer case, a plurality of vanes located in a gas path defined between the inner hub and the outer case, and a plurality of support members affixed between the inner hub and the outer case that transfer loads from the inner hub to the outer case. The outer case includes a plurality of support member bosses that receive and affix the support members to the outer case and a plurality of gusseted bosses disposed circumferentially around the outer case and between the plurality of support member bosses.

In one embodiment, the plurality of gusseted bosses may include a flat portion extending from the outer case that is substantially parallel to an engine centerline axis and a curved portion extending between the outer case and the flat portion that is substantially perpendicular to the flat portion.

In another embodiment, the plurality of gusseted bosses may be axially aligned with the support member bosses.

In another embodiment, the plurality of gusseted bosses are located to maintain system stiffness symmetry.

In another embodiment, the plurality of gusseted bosses are located circumferentially around the outer case to provide ovalization control of the outer case.

In another embodiment, seven gusseted bosses are disposed circumferentially around the outer case.

In an exemplary embodiment, a gas turbine engine includes a fan section, a compressor section located downstream from the fan section, a combustor section, a high pressure turbine section located downstream from the combustor section, a low pressure turbine section located downstream for the high pressure turbine section, and a mid-turbine frame section disposed between the high pressure turbine section and the low pressure section. The mid-turbine frame section includes an inner hub, an outer case, a plurality of vanes located in a gas path defined between the inner hub and the outer case, and a plurality of support members affixed between the inner hub and the outer case that transfer loads from the inner hub to the outer case. The outer case includes a plurality of support member bosses that receive and affix the support members to the outer case and a plurality of gusseted bosses disposed circumferentially around the outer case and between the plurality of support member bosses.

In one embodiment, the plurality of gusseted bosses may include a flat portion extending from the outer case that is substantially parallel to an engine centerline axis and a curved portion extending between the outer case and the flat portion that is substantially perpendicular to the flat portion.

In another embodiment, the plurality of gusseted bosses may be axially aligned with the support member bosses.

In another embodiment, the plurality of gusseted bosses are located to maintain system stiffness symmetry.

In another embodiment, the plurality of gusseted bosses are located circumferentially around the outer case to provide ovalization control of the outer case.

In another embodiment, seven gusseted bosses are disposed circumferentially around the outer case.

In this way, the present invention describes the use of gusseted bosses to provide ovalization control of an outer case in a gas turbine engine. Although the present invention has been described with reference to preferred embodiments, workers skilled in the art will recognize that changes may be made in form and detail without departing from the spirit and scope of the invention.

The invention claimed is:

1. An outer case employed in a gas turbine engine, the outer case comprising:

a plurality of support member bosses disposed circumferentially around the outer case for receiving and securing support members that attach the outer case to an inner hub; and a plurality of gusseted bosses disposed circumferentially around the outer case and between the plurality of support member bosses, wherein each of the plurality of gusseted bosses is solid and is solely connected to a single surface of the outer case.

2. The outer case of claim 1, wherein each of the plurality of gusseted bosses include:

a flat portion extending from the surface of the outer case that is substantially parallel to an engine centerline axis; and a curved portion extending between the surface of the outer case and the flat portion that is substantially perpendicular to the flat portion.

3. The outer case of claim 1, wherein the plurality of gusseted bosses are axially aligned with the support member bosses.

4. A mid-turbine frame portion of a gas turbine engine comprising the outer case of claim 1.

5. The outer case of claim 1, wherein the plurality of gusseted bosses are located to maintain system stiffness symmetry.

6. The outer case of claim 1, wherein the plurality of gusseted bosses are located circumferentially around the outer case to provide ovalization control of the outer case.

7. The outer case of claim 1, wherein seven gusseted bosses are disposed circumferentially around the outer case.

8. A mid-turbine frame comprising:

an inner hub;

an outer case;

a plurality of vanes located in a gas path defined between the inner hub and the outer case;

a plurality of support members affixed between the inner hub and the outer case that transfer loads from the inner hub to the outer case;

wherein the outer case includes:

a plurality of support member bosses that receive and affix the support members to the outer case; and a plurality of gusseted bosses disposed circumferentially around the outer case and between the plurality of support member bosses, wherein each of the plurality of gusseted bosses is solid and is solely connected to a single surface of the outer case.

9. The mid-turbine frame of claim 8, wherein each of the plurality of gusseted bosses include:

a flat portion extending from the surface of the outer case that is substantially parallel to an engine centerline axis; and a curved portion extending between the surface of the outer case and the flat portion that is substantially perpendicular to the flat portion.

10. The mid-turbine frame of claim 8, wherein the plurality of gusseted bosses are axially aligned with the support member bosses.

11. The mid-turbine frame of claim 8, wherein the plurality of gusseted bosses are positioned circumferentially around the outer case to provide ovalization control of the outer case.

12. The mid-turbine frame of claim 8, wherein seven gusseted bosses are disposed circumferentially around the outer case.

13. A gas turbine engine comprising:

a fan section;

a compressor section located downstream from the fan section;

a combustor section;

a high pressure turbine section located downstream from the combustor section;

a low pressure turbine section located downstream for the high pressure turbine section;

a mid-turbine frame section disposed between the high pressure turbine section and the low pressure section, the mid-turbine frame section comprising:

an inner hub;

an outer case;

a plurality of vanes located in a gas path defined between the inner hub and the outer case;

a plurality of support members affixed between the inner hub and the outer case that transfer loads from the inner hub to the outer case;

wherein the outer case includes:

a plurality of support member bosses that receive and affix the support members to the outer case; and a plurality of gusseted bosses disposed circumferentially around the outer case and between the plurality of support member bosses, wherein each of the plurality of gusseted bosses is solid and is solely connected to a single surface of the outer case.

14. The gas turbine engine of claim 13, wherein each of the plurality of gusseted bosses include:

a flat portion extending from the surface of the outer case that is substantially parallel to an engine centerline axis; and a curved portion extending between the surface of the outer case and the flat portion that is substantially perpendicular to the flat portion.

15. The gas turbine engine of claim 13, wherein the plurality of gusseted bosses are axially aligned with the support member bosses.

16. The gas turbine engine of claim 13, wherein the plurality of gusseted bosses are positioned circumferentially around the outer case to provide ovalization control of the outer case.

17. The gas turbine engine of claim 13, wherein seven gusseted bosses are disposed circumferentially around the outer case.

* * * * *